United States Patent [19]

Leppänen

[11] Patent Number: 4,786,213

[45] Date of Patent: Nov. 22, 1988

[54] DEVICE FOR STORING A WIRE IN A WIRE BOLTING MEANS

[75] Inventor: Jarmo Leppänen, Ylöjärvi, Finland

[73] Assignee: OY Tampella AB, Tampere, Finland

[21] Appl. No.: 168,521

[22] Filed: Mar. 7, 1988

Related U.S. Application Data

[63] Continuation of Ser. No. 925,569, Oct. 31, 1986.

[30] Foreign Application Priority Data

Nov. 7, 1985 [FI] Finland ..... 854381

[51] Int. Cl.[4] ..... E21D 20/00

[52] U.S. Cl. ..... 405/303; 242/129; 405/259

[58] Field of Search ..... 405/259, 260, 261, 303, 405/269; 242/129, 86, 54 A

[56] References Cited

U.S. PATENT DOCUMENTS

| | | | |
|---|---|---|---|
| 2,985,404 | 5/1961 | Tashiro | 242/129 |
| 3,593,943 | 7/1971 | Collmann | 242/129 |
| 3,608,710 | 9/1971 | Pugh | 242/129 X |
| 3,744,734 | 7/1973 | Lodato et al. | 242/129 |
| 3,797,589 | 3/1974 | Kellner et al. | 175/203 X |
| 3,809,333 | 5/1974 | Lefever | 242/129 |
| 3,815,845 | 6/1974 | Rygiol | 242/129 |
| 4,079,592 | 3/1978 | Eakin | 405/260 |
| 4,151,965 | 5/1979 | Manabe | 242/129 X |
| 4,589,803 | 5/1986 | Totten | 405/259 |

FOREIGN PATENT DOCUMENTS

| | | | |
|---|---|---|---|
| 2751564 | 5/1978 | Fed. Rep. of Germany | 175/203 |

*Primary Examiner*—Dennis L. Taylor

*Attorney, Agent, or Firm*—Birch, Stewart, Kolasch & Birch

[57] ABSTRACT

A device for storing wire in a wire bolting arrangement, which device comprises a reel which supports a ring-shaped wire coil, and a supporter on which the reel is mounted for rotation. In order to prevent unintentional unwinding of the coil, and in order to simplify the replacement of the device, the reel is formed as an essentially closed housing which encloses the wire coil and which is provided with a central opening for drawing out a wire. The housing and the supporter are preferably formed as a separate, replaceable cassette fastened on the carrier of the bolting means.

17 Claims, 1 Drawing Sheet

DEVICE FOR STORING A WIRE IN A WIRE BOLTING MEANS

This application is a continuation of application Ser. No. 925,569 filed on Oct. 31, 1986.

This invention relates to a device for storing a wire in a wire bolting means, comprising a reel which supports a ring-shaped wire coil, and a supporter on which the reel is mounted for rotation.

In wire bolting, the rock is reinforced by means of wires pushed into holes drilled in the rock and fastened therein by means of a concrete mass. In mechanized wire bolting, string cords especially made for bolting are used; in the following these string cords will be called wires.

The wire manufacturer coils the wire into a wire coil at the factory. In the excavation, the wire coil is mounted either on a decoiling stand which allows the rotation of the coil when the wire is decoiled from the outer periphery of the coil, or within a fixed cage which is provided with an opening only in the middle of the coil for drawing out the wire.

In the first case the coil requires a separate transporting carriage. Since the cord is very rigid, a bent wire tends to get straight, wherefore the coil constantly tends to unwind and, consequently, the decoiling stand must be retarded and the end of the wire must not be allowed to go loose.

The latter alternative is disadvantageous because the cage protecting the coil is fixed and the wire in the coil is drawn out through the central opening of the cage, the wire tend to wind around the axis thereof with the result that the wire may get entangled within the coil. When the wire is drawn out, it tends to resume its coiled shape, and the wire end must be released to rotate every now and then in order to reduce the torsional tensions. A wire exposed to a torsional tension is always a security risk outside the cage, because a wire loop or the wire end may damage the machinery or injury the operator of the device when the tension is released.

SUMMARY OF THE INVENTION

The object of the present invention is to provide a device which avoids the above disadvantages. This object is achieved by means of a device according to the invention, which is characterized in that the reel is an essentially closed housing which encloses the wire coil and which is provided with a decoiling opening for drawing out a wire, said opening being concentric with the axis of rotation of the housing.

The invention is based on the idea that the wire coil is mounted in a closed space, a housing, in the excavation, which housing reliably prevents unintentional unwinding of the wire, and at the same time enables the wire to be decoiled out of the space in such a manner that no disadvantageous torsional tensions occur in the wire.

The wire can be drawn out from the middle of the housing, whereby the rotation of the housing prevents the formation of torsional tensions in the wire so that the wire is not recoiled when it is unwound. Since the wire coil is closed within the housing, and the wire is decoiled from the inner periphery of the coil, the housing prevents the wire from getting straight by itself, and it is not necessary to retard the rotation of the housing. The housing does not, either, need any rotation machinery. As the housing is mounted for easy rotation, the wire can be decoiled from the housing by pulling slightly.

It is of advantage to position a drum centrally in the housing, whereby the drum and the central opening of the housing together form a narrow annular slot through which the wire sticks out from the housing. The drum prevents the wire from getting entangled, and when the wire is drawn out of the housing the wire forms one winding or so around the drum and forces the housing to rotate.

The housing and the supporter thereof are preferably formed as a replaceable cassette so that an empty cassette is easily removable from the bolting means and a new full cassette can be mounted in place thereof. The replacement of the wire coil is thereby considerably speeded up as well as simplified. The cassette can be replaced at the excavation store or at the maintaining place.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will be described more fully in the following with reference to the attached drawing which are given by way of illustration only, and thus not limitative of the present invention, and wherein.

DETAILED DESCRIPTION OF THE PREFERRED EMBODIMENTS

Figure 1:
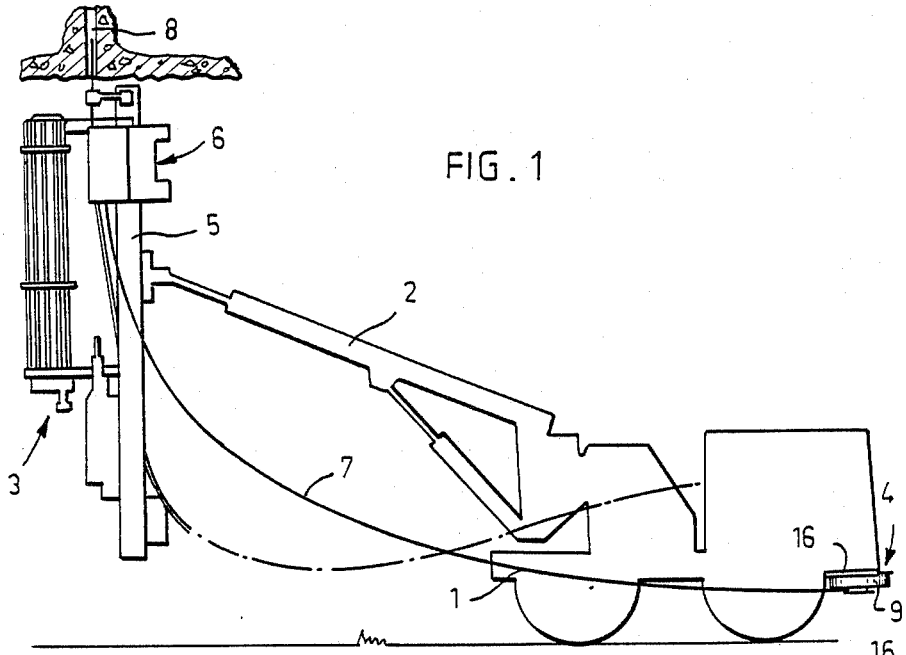
FIG. 1 is a schematic view of a bolting means provided with a wire cassette device according to the invention.
Figure 2:
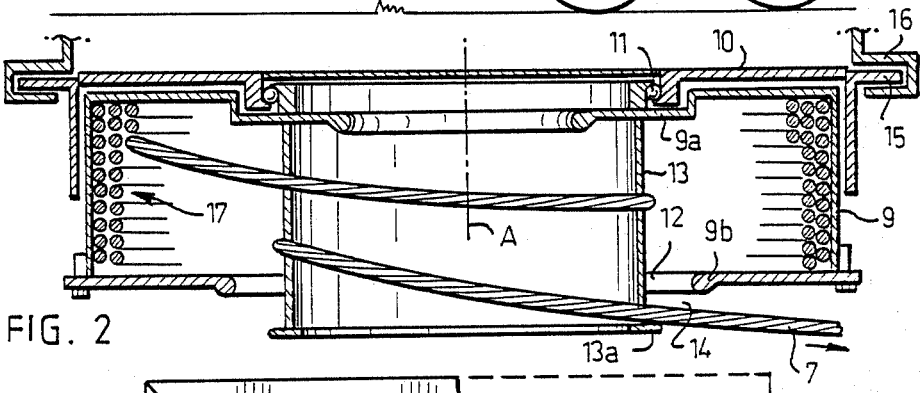
FIG. 2 is an enlarged axial section of the wire cassette.
Figure 3:
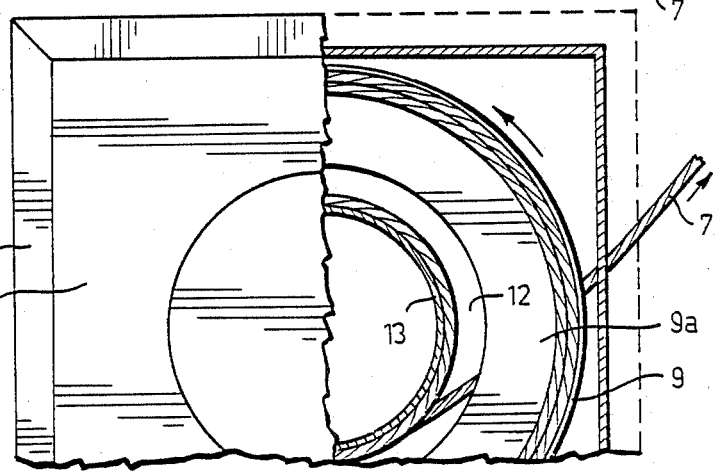
FIG. 3 is a top view of the wire cassette as a partial horizontal section.

FIG. 1 of the drawings illustrates a wire bolting means which is of a structure known per se and comprises a carrier 1 which supports a bolting equipment 3 by means of a boom system 2. The carrier supports a wire magazine 4 out of which a feeding mechanism supported by a feeding beam 5 of the bolting equipment draws a wire 7 through it and pushes it into a drill hole 8 made in the rock.

The wire magazine 4 is formed by a wire cassette, which comprises a cylindrical housing 9 and a square platelike supporter 10. The housing is at one end **9*a* thereof mounted under the supporter by means of a bearing 11 to be rotatable around the axis A of the housing. The other end 9*b* of the housing is provided with a central opening 12**.

A cylindrical drum 13 is attached to the first-mentioned end of the housing in such a manner that it extends through the central opening and beyond it to form therein an annular guide edge **13*a*. An annular decoiling slot 14** is thereby formed between the edge of the central opening of the housing and the guide edge of the drum.

Slide bars 15 are attached to the two opposite sides of the supporter, and the carrier 1 of the bolting device is provided with corresponding supporting guides 16 on which the slide bars of the cassette can be pushed.

The wire cassette operates in the following way:

The housing is filled with a wire coil 17, for which purpose the end **9*b*** of the housing is openable. The cassette is pushed on the slide bars on to the supporting guides of the carrier and locked in position by means of locking means not shown. When the wire is drawn out of the housing through the decoiling slot, the housing rotates on the supporter. When the wire is drawn out of the housing, it forms one winding or so around the drum and forces the housing to rotate in proportion as the wire is drawn out of the housing.

After the wire has ran out in the housing, the cassette is drawn away from the supporting guides and it is replaced with a new full cassette.

The drawing and the description related thereto are only intended to illustrate the idea of the invention. In its details, the device according to the invention may vary within the scope of the claims.

What is claimed is:

1. A device for storing wire for use in a wire bolting means, said device comprising:

a reel for supporting a ring-shaped wire coil, said reel forming a closed housing for enclosing the wire coil, said reel having a first and second surface, said second surface having an opening through which said wire may be completely withdrawn for wire bolting;

a supporter on which said reel is mounted for rotation about an axis, said opening being concentric with said axis; and a drum provided centrally in said reel around which a portion of said wire rotates, said wire being in engagement with said drum over at least one winding thereof, said wire forcing the reel to rotate relative to the supporter as said wire is withdrawn and, said drum extending through said opening for forming an annular decoiling slot with said opening through which said wire is withdrawn.

2. A device according to claim 1, wherein the reel is cylindrical and mounted on the supporter to rotate around its axis.

3. A device according to claim 1 wherein the reel and the supporter are formed as a separate, replaceable cassette.

4. A device according to claim 3, wherein the supporter is mounted on the carrier of the wire bolting means, by using parallel slide bars provided on the two opposite sides of the supporter, said slid bars being adapted to be pushed on to supporting guides provided on the carrier for removably fastening the device on the carrier.

5. A device according to claim 2, wherein the reel and the supporter are formed as a separate, replaceable cassette.

6. The device according to claim 1, wherein said drum extends through said opening and wherein said drum and said opening form an annular decoiling slot through which said wire is withdrawn.

7. The device according to claim 1, wherein said reel and said supporter are formed as a separate, replaceable cassette.

8. The device according to claim 1, wherein said wire coil has a first end which is initially withdrawn through said opening and a second end which is unattached to said reel such that said entire wire coil is withdrawn from said reel during operation of said device.

9. The device for storing a wire as recited in claim 1 wherein said opening in said bottom surface of said reel permits said wire to be withdrawn from the bottom of said reel and to then be fed in a substantially horizontal direction relative to said bottom surface.

10. The device for storing a wire as recited in claim 1, wherein said first surface of said reel is a top surface and said second surface of said reel is a bottom surface and said axis about which said reel rotates is generally vertical.

11. The device for storing a wire as recited in claim 1, wherein said first and second surfaces of said reel are side surfaces thereof and said axis about which said reel rotates is generally horizontal.

12. A portable means for wire bolting having a device for storing a wire, said wire bolting means comprising a movable carrier and bolting equipment attached to said carrier, said carrier having a bottom side to which said device for storing is attached, said bolting equipment being attached to an end of said carrier which is opposite an end at which said device for storing is located, said device for storing comprising:

a supporter for detachably affixing said device to the bottom side of said carrier;

a reel for supporting a ring-shaped wire, coil, said reel forming a closed housing for enclosing the wire coil, said reel having a top and bottom surface, said top surface being adjacent said supporter and said bottom surface having an opening therein;

a drum provided centrally in said reel around which said wire is initially wound;

means for rotatably attaching said drum and said reel to said supporter whereby both said drum and said reel are rotatable to permit discharge of said wire from said reel, said wire being drawn from said coil, around said drum, through said opening in the bottom surface of said reel and beneath said carrier to said bolting equipment; and means located on the bottom side of the carrier for receiving said supporter said means for receiving enabling said supporter along with said reel, said drum and said means for rotatably attaching to be attached to and detached from the bottom side of said carrier whereby when said wire is completely discharged, said reel, said drum and said means for rotatably attaching may be detached from said carrier and replaced with a reel, drum and means for rotatably attaching having wire within the reel.

13. The portable means for wire bolting having the device for storing as recited in claim 12 wherein said drum extends through the opening in the bottom surface of said reel whereby said opening and drum form an annular slot through which said wire is discharged.

14. The portable means for wire bolting having the device for storing as recited in claim 12 wherein said supporter further comprises slide bars extending from at least two sides thereof and wherein said means for receiving said supporter comprises at least two U-shaped grooves for receiving said slide bars whereby said supporter, said reel, said drum and said means for rotatably attaching are slide in a generally horizontal direction for attachment to and detachment from the bottom side of said carrier.

15. The portable means for wire bolting having the device for storing as recited in claim 12 wherein said means for rotatably attaching comprises bearings located between said supporter and said drum.

16. A method for unloading and using wire from a device for storing said wire, said device comprising a reel, a supporter having an opening in a bottom surface thereof and a centrally located drum, said device being attachable beneath a portable carrier, said method comprising the steps of:

initially storing said wire within said reel, said wire being wound in a coil encircling said drum;

inserting said reel, said supporter and said drum with said wire beneath said portable carrier;

withdrawing an end of said wire through said opening in the bottom surface of said drum;

discharging all of said wire from said reel through said opening in the bottom surface of said drum;

rotating at least said reel during said discharging;

engaging a portion of said wire with said drum during said discharging;

moving wire discharged from said reel beneath said carrier, said wire being moved between opposite ends of the carrier;

feeding said wire to bolting equipment located on said carrier; and inserting said wire into a hole in at least a rock by said bolting equipment whereby said wire aids in bolting said rock.

17. The method as recited in claim 16 wherein the step of inserting said reel comprises sliding said reel, said supporter and said drum in a generally horizontal direction.

* * * * *